US009345340B2

(12) United States Patent
Walters et al.

(10) Patent No.: US 9,345,340 B2
(45) Date of Patent: May 24, 2016

(54) DISPENSING MECHANISM FOR UTENSIL DISPENSER AND RELATED METHODS

(75) Inventors: Richard S. Walters, Port Washington, WI (US); Morgan J. Lowery, DeForest, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 10 days.

(21) Appl. No.: 13/315,331

(22) Filed: Dec. 9, 2011

(65) Prior Publication Data

US 2012/0145736 A1 Jun. 14, 2012

Related U.S. Application Data

(60) Provisional application No. 61/421,998, filed on Dec. 10, 2010.

(51) Int. Cl.
*B65G 59/06* (2006.01)
*A47F 1/10* (2006.01)

(52) U.S. Cl.
CPC ..... *A47F 1/10* (2013.01); *A47F 2001/103* (2013.01)

(58) Field of Classification Search
CPC ..... A47F 2001/103; A47F 1/10
USPC ..... 221/191, 194, 195
See application file for complete search history.

(56) References Cited

U.S. PATENT DOCUMENTS

| | | | |
|---|---|---|---|
| 46,832 | A | 3/1865 | Thorpe |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 6/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |
| 1,504,098 | A | 8/1924 | Cathey |
| 1,546,077 | A | 7/1925 | Hunter et al. |
| 1,547,151 | A | 7/1925 | Watling |
| 1,560,938 | A | 11/1925 | Lund |
| 1,577,302 | A | 3/1926 | Schultz |
| 1,610,001 | A | 12/1926 | Foster |
| 1,635,386 | A | 7/1927 | Pierson |
| 1,675,510 | A | 7/1928 | Nolan |
| 1,767,634 | A | 6/1930 | Weiss |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.

(Continued)

*Primary Examiner* — Michael K Collins

(57) ABSTRACT

A dispenser for dispensing cutlery may include a housing configured to contain a plurality of utensils for dispensing, a dispensing mechanism comprising at least one pair of indexing members configured to separate a utensil from a stack of utensils, and a receptacle configured to receive the utensil separated from the stack of utensils. A dispensing mechanism may alternatively include a plurality of linked members configured to separate a utensil from a stack of utensils.

36 Claims, 3 Drawing Sheets

(56) References Cited

U.S. PATENT DOCUMENTS 1,821,377 A 9/1931 Cusick
1,886,378 A 11/1932 Dearsley
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler, Sr.
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,340,561 A 2/1944 Renfro
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,497,718 A 2/1950 Earley et al.
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,752,678 A 7/1956 Welch
2,800,013 A 7/1957 George
2,806,634 A 9/1957 Baumgartner
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,889,076 A 6/1959 Van Schie
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
2,965,262 A 12/1960 Du Bois
3,037,257 A 6/1962 Girodet
3,052,006 A 9/1962 Jonas
3,054,528 A 9/1962 Loomis
3,083,879 A 4/1963 Coleman
3,095,114 A 6/1963 Tobias
3,100,842 A 8/1963 Tellefsen
3,114,475 A 12/1963 Etes
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,334,784 A 8/1967 Morrison
3,338,471 A 8/1967 Good
3,371,821 A 3/1968 Abood, Jr. et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Baller
3,499,538 A 3/1970 Sherard
3,558,006 A 1/1971 Redmond et al.
3,587,922 A 6/1971 Oriti
3,654,396 A 4/1972 Biezeveld
3,680,736 A 8/1972 Viessmann
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,861,563 A 1/1975 Lisbin
3,862,702 A 1/1975 Johnson
3,897,886 A * 8/1975 Franklin ..... 221/222
3,932,978 A 1/1976 Kinney
3,972,118 A 8/1976 Richard
3,987,901 A 10/1976 Dullinger
3,998,238 A 12/1976 Nigro
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A * 11/1986 Freese ..... 414/797.7
4,662,536 A 5/1987 Powers
4,666,060 A 5/1987 Bouldin
4,676,504 A 6/1987 Ponza
4,691,811 A 9/1987 Arakawa et al.
4,697,673 A 10/1987 Omata
4,707,251 A 11/1987 Jenkins
4,715,514 A 12/1987 Vidondo
4,789,064 A 12/1988 Segal
4,835,864 A 6/1989 Tang
4,863,033 A 9/1989 Buj
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,961,684 A 10/1990 Provan et al.
4,963,072 A 10/1990 Miley et al.
4,973,037 A 11/1990 Holbrook
4,986,442 A 1/1991 Hinterreiter
4,995,154 A 2/1991 Bamber
D318,600 S 7/1991 Lillelund et al.
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,161,268 A 11/1992 Harrow

(56) References Cited

U.S. PATENT DOCUMENTS 5,176,494 A 1/1993 Nigrelli et al.
5,191,997 A 3/1993 Squitieri
5,211,267 A 5/1993 Clark
5,249,705 A 10/1993 Gates
5,263,596 A 11/1993 Williams
D342,648 S 12/1993 Cautereels et al.
5,269,397 A 12/1993 Kawamoto et al.
5,327,650 A 7/1994 Rojas
D351,085 S 10/1994 Schmidt
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A 5/1999 De Schutter
5,921,408 A 7/1999 Groenewold et al.
5,933,918 A 8/1999 Wallays
5,950,842 A 9/1999 Bauer
5,961,021 A * 10/1999 Koike ..... B26F 3/002 225/103
D420,887 S 2/2000 Chen
6,023,908 A * 2/2000 Vetsch ..... 53/155
6,023,913 A 2/2000 Gray et al.
D422,431 S 4/2000 Goins
6,047,830 A 4/2000 Chang
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,498 B1 6/2001 Lovejoy
6,289,889 B1 9/2001 Bell et al.
6,298,960 B1 10/2001 Derr
6,336,568 B1 * 1/2002 Tucker et al. ..... 221/131
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 * 9/2004 Renard ..... 221/197
6,786,359 B1 9/2004 Schroeder
6,832,694 B2 * 12/2004 Goeking et al. ..... 221/195
6,832,698 B1 12/2004 Dybul
6,837,028 B1 1/2005 Miano et al.
6,840,353 B2 1/2005 Arisaka
6,840,420 B1 1/2005 Hudson
6,880,211 B2 4/2005 Jackson et al.
6,895,672 B2 5/2005 Conforti
6,945,427 B2 9/2005 Hieb
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,210,279 B1 5/2007 Ahmed et al.
7,237,700 B2 7/2007 Bulovic
7,322,172 B2 1/2008 Hoffman et al.
D564,819 S 3/2008 Fosburg et al.
7,412,808 B2 8/2008 Lavi
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Talmer et al.
7,819,234 B2 10/2010 Herzog
7,856,722 B2 12/2010 Lago-Arenas
8,070,013 B2 12/2011 Reinsel et al.
8,152,004 B2 4/2012 Smith et al.
8,272,533 B1 9/2012 D'Amelia
8,296,957 B2 10/2012 Muehlemann
8,297,473 B2 10/2012 Smith
8,302,269 B2 11/2012 Pitman
8,360,273 B2 * 1/2013 Reinsel et al. ..... 221/131
8,480,954 B2 7/2013 Talmer et al.
2002/0112445 A1 8/2002 Scaduto
2003/0015824 A1 1/2003 Forbes et al.
2003/0146061 A1 8/2003 Tournier
2004/0045398 A1 3/2004 Hayashi
2004/0045860 A1 3/2004 Edgerly et al.
2004/0089670 A1 5/2004 Goeking et al.
2004/0237311 A1 12/2004 Brown et al.
2005/0082307 A1 4/2005 Tucker
2005/0155186 A1 7/2005 McGuyer et al.
2005/0155229 A1 7/2005 Lee
2005/0252057 A1 11/2005 Lavi
2006/0000190 A1 1/2006 Behnke et al.
2006/0218795 A1 10/2006 Santa Cruz et al.
2007/0035943 A1 2/2007 Wang
2007/0108141 A1 5/2007 Smith et al.
2007/0131705 A1 6/2007 Behravesh et al.
2007/0193968 A1 * 8/2007 Smith et al. ..... 211/70.7
2007/0214650 A1 9/2007 Tomazini
2007/0250391 A1 10/2007 Prade et al.
2008/0121650 A1 * 5/2008 Smith ..... 221/129
2008/0128445 A1 6/2008 Huang et al.
2009/0194557 A1 8/2009 Van Deursen
2010/0000096 A1 1/2010 Muehlemann
2010/0084418 A1 * 4/2010 Reinsel et al. ..... 221/1
2010/0147869 A1 6/2010 Iliffe et al.
2010/0170915 A1 7/2010 Reinsel et al.
2011/0180562 A1 7/2011 Reinsel et al.
2011/0226797 A1 9/2011 Reinsel et al.
2011/0266300 A1 11/2011 Schwarzli
2011/0296693 A1 12/2011 Oakes
2012/0036724 A1 2/2012 Walters
2012/0047744 A1 3/2012 Walters
2012/0080444 A1 4/2012 Smith et al.
2012/0110746 A1 5/2012 Serrano
2012/0145734 A1 6/2012 Walters
2012/0145735 A1 6/2012 Erickson et al.
2013/0032609 A1 2/2013 Righetti et al.
2013/0043272 A1 2/2013 Oakes
2013/0134211 A1 5/2013 Linkel
2013/0152406 A1 6/2013 McFarland
2013/0193157 A1 8/2013 Jongen et al.
2014/0069930 A1 3/2014 Oakes
2014/0191024 A1 7/2014 Wnek et al.

FOREIGN PATENT DOCUMENTS

CN 101495015 A 7/2009
DE 7033238 U1 11/1970
DE 7127677 U 11/1971
DE 3151268 7/1983
DE 4139938 6/1993
DE 9316566 1/1994

(56) References Cited

FOREIGN PATENT DOCUMENTS

| | | | |
|---|---|---|---|
| DE | 19906369 | | 2/2000 |
| DE | 202005013647 | U1 | 7/2006 |
| EP | 0257109 | A1 | 8/1986 |
| EP | 0856272 | A2 | 1/1999 |
| EP | 1022107 | A1 | 7/2000 |
| EP | 1217923 | B1 | 9/2003 |
| EP | 1358827 | A3 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | H06121727 | A | 5/1994 |
| JP | 08-047440 | A | 2/1996 |
| JP | 2007319493 | A | 12/2007 |
| KR | 1991-0008085 | Y1 | 10/1991 |
| KR | 10-2009-0071515 | A | 7/2009 |
| TW | M287639 | U | 2/2006 |
| TW | M293720 | U | 7/2006 |
| WO | 01/05280 | A1 | 1/2001 |
| WO | 01/05281 | A1 | 1/2001 |
| WO | 01/68492 | A1 | 9/2001 |
| WO | 2004/028309 | A1 | 4/2004 |
| WO | 2007/049982 | A1 | 5/2007 |
| WO | 2007/012606 | A1 | 11/2007 |
| WO | 2008/058187 | A2 | 5/2008 |
| WO | 2009137367 | A2 | 11/2009 |

OTHER PUBLICATIONS

Tack Rolling Ball, Aug. 1989, pp. 29-30.
Holding Power of Pressure-Sensitive Tape, Aug. 1989, pp. 31-33.
European Patent Report 06009258.2, mailed Jul. 24, 2006, five pages, Munich, Germany.
International Search Report and Written Opinion for PCT/US07/83752, mailed Mar. 11, 2008, ten pages, European Patent Office, Munich, Germany.
Partial International Search Report for PCT/US2007/083922, mailed Jul. 8, 2008, two pages.
European Search Report for EP 08 014 387.8 mailed Nov. 11, 2008, two pages, European Patent Office, Munich, Germany.
International Search Report and Written Opinion for PCT/US2007/083922, mailed Nov. 17, 2008, 13 pages, European Patent Office, Rijswijk, Netherlands.
International Search Report and Written Opinion for PCT/US2009/059915, mailed Feb. 3, 2010, 13 pages, European Patent Office, Munich, Germany.
Office Actions for U.S. Appl. No. 11/556,808 filed Nov. 6, 2006.
Office Actions for U.S. Appl. No. 11/415,836 filed May 2, 2006.
Office Actions for U.S. Appl. No. 11/936,401 filed Nov. 7, 2007.
Office Action for U.S. Appl. No. 12/349,203 filed Jan. 6, 2009.
International Search Report and Written Opinion of the International Search Authority for PCT/US2011/064057 mailed Feb. 29, 2012.
International Search Report and Written Opinion for PCT/US2011/044931 mailed Feb. 28, 2012.
International Search Report and Written Opinion for PCT/US2011/044934 mailed Mar. 6, 2012.
International Search Report and Written Opinion for PCT/US2011/058767 mailed Feb. 29, 2012.
International Search Report and Written Opinion for PCT/US2011/058329 mailed Feb. 29, 2012.
European Search Report dated Sep. 25, 2013 for Application No. 11793088.3.

* cited by examiner

DISPENSING MECHANISM FOR UTENSIL DISPENSER AND RELATED METHODS

CROSS-REFERENCE TO RELATED APPLICATION

This application claims priority to U.S. Provisional Patent Application No. 61/421,998 filed Dec. 10, 2010, the disclosure of which is incorporated herein in its entirety by this reference.

FIELD OF THE INVENTION

The present disclosure relates to dispensing cutlery. In particular, the present disclosure relates to dispensers for dispensing utensils, dispensing mechanisms for dispensing utensils, and related methods.

BACKGROUND

Disposable cutlery may be provided as a less expensive alternative to reusable cutlery, for example, at restaurants and social gatherings where it is undesirable or cost prohibitive to clean the cutlery for reuse. However, providing disposable cutlery may present a number of potential drawbacks related to the nature in which it is dispensed.

For example, providing disposable cutlery in a loose or unpackaged fashion, such as in loose form in a receptacle containing the disposable cutlery, may result in patrons taking more cutlery than necessary, thereby increasing the cost of providing the cutlery. In addition, providing loose or unpackaged cutlery may present concerns regarding whether dispensing cutlery in such a manner is hygienic. As a result, it may be desirable to dispense disposable cutlery in a manner other than in a loose or unpackaged form.

The above-noted concerns may be addressed by dispensing disposable cutlery from dispensers configured to contain a supply of the cutlery and dispense a disposable utensil upon operation of a patron. However, the complexity and expense of many dispensers may reduce the benefit to the purchaser of the dispenser. Thus, it may be desirable to provide a simple and reliable dispenser in order to further reduce costs and increase efficiency.

In addition, it may be desirable to provide a dispenser that is capable of dispensing utensils without flipping or otherwise altering the orientation of the utensils during the dispensing process. For example, some dispensers may cause utensils to flip or rotate within the dispenser as a stack of the utensils slides within the dispenser, which may lead to jamming the dispenser, thereby potentially compromising its utility.

Additionally, it may be desirable to provide a dispenser capable of reliably dispensing utensils. Dispensers that lack a reliable dispensing mechanism may have a tendency to cause patrons to unintentionally dispense more than one utensil at a time and/or jam the dispenser such that no utensils can be dispensed until the dispenser is manually un-jammed. This may result in compromising one of the potential advantages of dispensing utensils via a dispenser—reducing costs associated with patrons taking more utensils than necessary.

Thus, it is desirable to provide a system and method for addressing one or more of the potential drawbacks discussed above.

SUMMARY

In the following description, certain aspects and embodiments will become evident. It should be understood that the aspects and embodiments, in their broadest sense, could be practiced without having one or more features of these aspects and embodiments. Thus, it should be understood that these aspects and embodiments are merely exemplary.

One aspect of the disclosure relates to a dispenser for dispensing cutlery. The dispenser may include a housing configured to contain a plurality of utensils for dispensing, a dispensing mechanism that includes at least one pair of indexing members configured to separate a utensil from a stack of utensils, wherein the at least one pair of indexing members comprises rotors configured to separate the utensil from a stack of utensils via rotation of the rotors, and a receptacle configured to receive the utensil separated from the stack of utensils.

Another aspect relates to a dispenser for dispensing cutlery. The dispenser may include a housing configured to contain a plurality of utensils for dispensing, a dispensing mechanism that includes a plurality of linked members configured to separate a utensil from a stack of utensils, and a receptacle configured to receive the utensil separated from the stack of utensils.

Yet another aspect relates to a method for dispensing cutlery from a dispenser. The method may include providing a dispenser for dispensing cutlery, providing a plurality of utensils for dispensing, the utensils adapted to be positioned in within the dispenser, indexing at least two indexing members such that a utensil can be separated from a stack of utensils, the at least two indexing members comprising rotors configured to separate the utensil from a stack of utensils via rotation of the rotors, and providing access to the utensil separated from the stack of utensils.

A further aspect relates to a method for dispensing cutlery from a dispenser. The method may include providing a dispenser for dispensing cutlery, the dispenser including a plurality of linked members, providing a plurality of utensils for dispensing, the utensils adapted to be positioned within the dispenser, manipulating at least one of a plurality of linked members such one of the plurality of utensils is separated from a stack of utensils, and providing access to the utensil separated from the stack of utensils.

BRIEF DESCRIPTION OF THE DRAWINGS

The accompanying drawings, which are incorporated in and constitute a part of this description, illustrate several embodiments and together with the description, serve to explain principles of the embodiments. In the drawings.

DETAILED DESCRIPTION OF EMBODIMENTS

Figure 1:
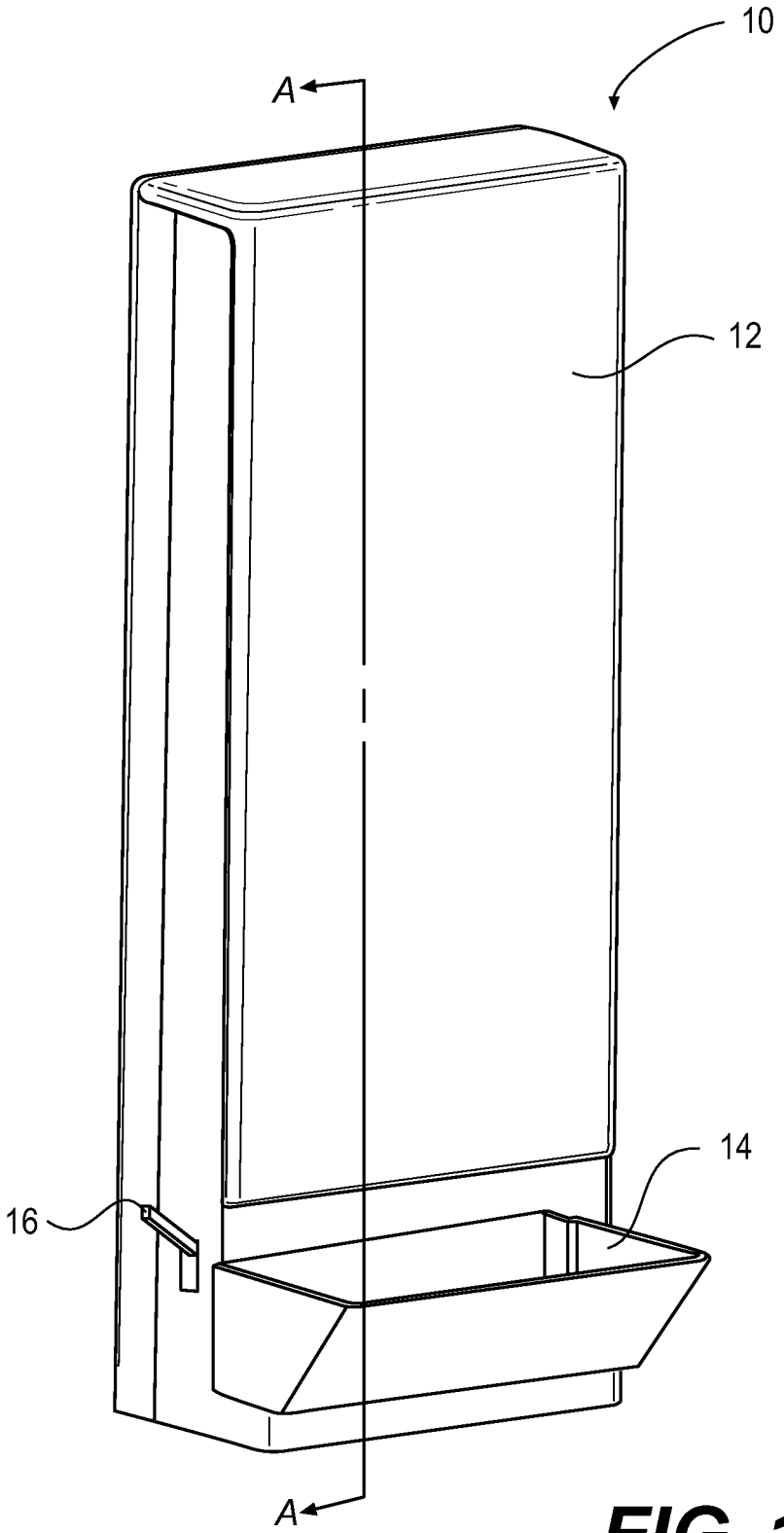
FIG. 1 is a schematic perspective view of an embodiment of a dispenser for dispensing utensils.

Reference will now be made in detail to various embodiments. Wherever possible, the same reference numbers are used in the drawings and the description to refer to the same or like parts.

FIG. 1 shows a schematic perspective view of a dispenser 10 for dispensing utensils. Dispenser 10 includes a housing 12 configured to store a plurality of utensils 20 (see FIGS. 2A, 2B, 4A, and 4B). Housing 12 may be configured to receive utensils 20 in various arrangements. Housing 12 may be configured to receive one or more of loose utensils, cartridges containing utensils, stacks of utensils bound by a wrapper, and/or stacks of utensils removably coupled to one another. For example, housing 12 may include a chute 13 configured to receive a plurality of utensils 20 in a stack. Chute 13 of housing 12 may feed a dispensing mechanism 18 (see, e.g., FIGS. 2A, 2B, 4A, and 4B), which is configured to dispense at least one utensil 20, for example, individually.

Dispenser 10 includes a receptacle 14 configured to receive utensils 20 dispensed from housing 12 by a dispensing mechanism 18. Dispensing mechanism 18 may be located inside dispenser 10. In some embodiments, dispensing mechanism 18 is located inside housing 12. Dispenser 10 may include an actuator 16 for operation of dispenser 10 by a user. Actuator 16 may be configured to activate dispensing mechanism 18 in order to dispense a utensil 20 from a stack of utensils in chute 13. While FIG. 1 shows actuator 16 in the form of a handle, actuator 16 may be provided in any suitable form, for example, a rotatable knob, a button, a switch, a bar, an electronic sensor (e.g., a proximity sensor), and/or a crank. Additionally, according to some embodiments, actuator 16 may be incorporated into other aspects of dispenser 10. For example, actuator 16 may be incorporated into receptacle 14, such that a user may activate actuator 16 by manipulating receptacle 14 directly in order to operate dispensing mechanism 18. In some embodiments, actuator 16 may be incorporated into other aspects of dispenser 10, such as, for example, housing 12.

Figure 2B:
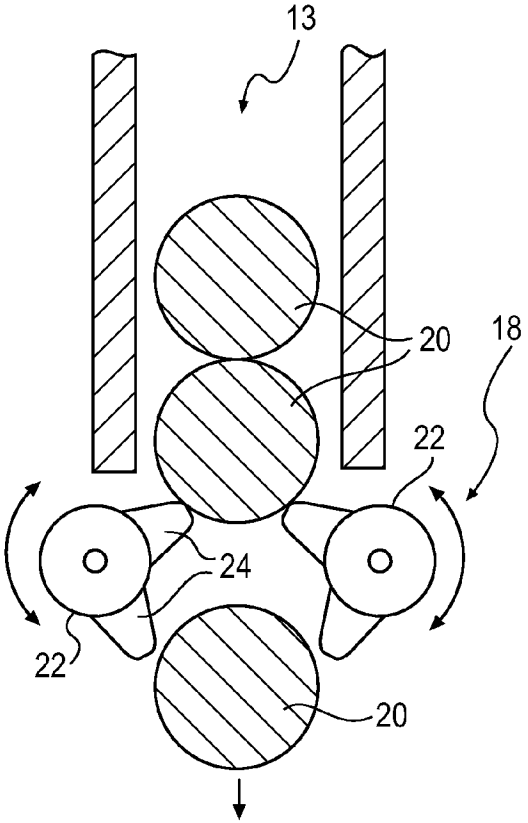
FIG. 2B is a schematic partial cross-sectional view along line A-A of FIG. 1 showing the dispensing mechanism of FIG. 2A in a second condition.
Figure 2A:
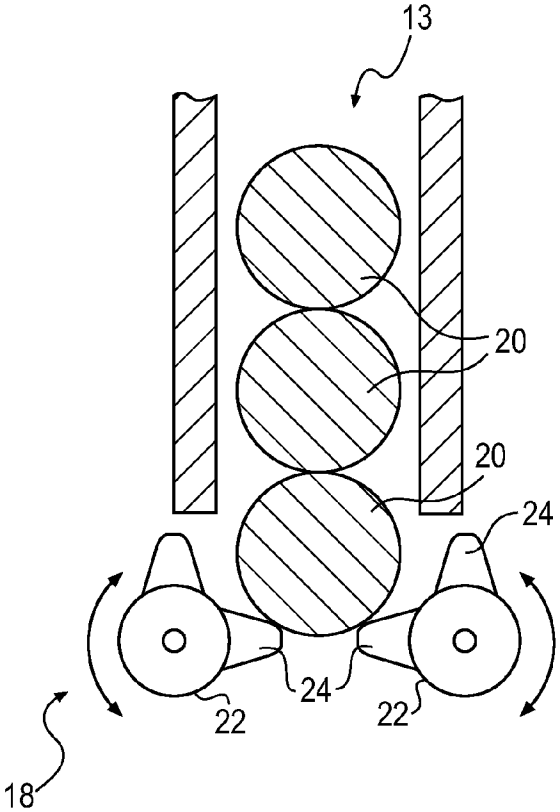
FIG. 2A is a schematic partial cross-sectional view along line A-A of FIG. 1 showing a dispensing mechanism in a first condition.

FIG. 2A shows a schematic partial cross-sectional view along line A-A of FIG. 1. Specifically, FIG. 2A shows a cross-sectional view of dispensing mechanism 18 and a portion of a stack of utensils 20 in chute 13 in a first condition in which dispensing is not in progress. Utensils 20 are shown with a round cross-sectional shape; however, it is anticipated that utensils 20 may have any cross-sectional shape, including rectangular, square, triangular, and/or other variations common for disposable cutlery. In some embodiments, utensils 20 may have variable cross-sectional shapes, such that, for example, the portion of utensil 20 that is anticipated to contact dispensing mechanism 18 may be shaped to facilitate dispensing (e.g., it may have a handle portion that is generally rectangular in cross-section with rounded edges), while other portions of utensil 20 may have different cross-sectional shapes. According to some embodiments, utensils 20 may be any type of utensil, including, for example, at least one of a spoon, a fork, a knife, and a spork. Utensils 20 may be constructed from a formable material. The formable material may include, for example, plastic, combinations of plastics, or combinations of plastics and other materials suitable for use as disposable or reusable cutlery. For example, the formable material may include one or more of polystyrene, polyethylene, and polypropylene.

According to some embodiments, dispensing mechanism 18 may facilitate the dispensing of utensils 20 from a stack of utensils. In particular, dispensing mechanism 18 may be configured to retain a plurality of utensils 20 inside housing 12 until a user operates actuator 16 of dispenser 10. During operation, dispensing mechanism 18 may separate at least one utensil 20 from a stack of utensils and allow the at least one utensil 20 to proceed, for example, via gravity, from chute 13 to receptacle 14, where it may be received by a user. In some embodiments, dispensing mechanism 18 may be operated via actuator 16. For example, a user may operate actuator 16 in a downward direction in order to operate dispensing mechanism 18 and dispense utensil 20. The method of operating actuator 16 in order to operate dispensing mechanism 18 may depend on the form of actuator 16, which may be provided in any suitable form, for example, a rotatable knob, a button, a switch, a bar, an electronic sensor, and/or a crank.

FIG. 2A shows dispensing mechanism 18, including at least one pair of indexing members 22. While FIG. 2A shows one pair of indexing members 22, any number of indexing members 22 may be utilized by dispensing mechanism 18 including a single indexing member 22. In some embodiments, each indexing member 22 comprises at least one rotatable rotor and at least one indexing protrusion 24. For example, FIG. 2A shows a pair of indexing members 22 that each comprise two indexing protrusions 24 disposed on rotatable rotors. In some embodiments, indexing members 22 may each include any number of indexing protrusions 24, for example, 3, 4, 5, or more, indexing protrusions 24. Indexing members 22 may be configured to have an initial orientation that retains utensils 20 within chute 13. According to some embodiments, at least one indexing protrusion 24 comes into contact with a utensil 20 positioned to be dispensed first (e.g., a utensil 20 at the bottom of the stack of utensils in chute 13). For example, FIG. 2A shows a pair of indexing members 22 positioned such that one utensil 20 rests on indexing protrusions 24.

According to some embodiments, indexing members 22 may be configured to index in a manner that separates one utensil 20 from the stack of utensils. For example, FIG. 2A shows indexing members 22 configured to rotate at least an amount sufficient to release utensil 20 from the stack of utensils in chute 13. The amount of rotation necessary to release utensil 20 may depend on the size and shape of utensil 20, the size and shape of indexing members 22, the location of indexing members 22 relative to each other and to utensils 20, and/or the configuration and/or number of indexing protrusions 24.

FIG. 2B shows a similar schematic partial cross-sectional view along line A-A of FIG. 1 in a second condition in which utensil 20 is being dispensed. In the embodiment shown in FIG. 2B, indexing members 22 are capable of rotatably separating a utensil 20 from a stack of utensils. FIG. 2B shows the embodiment of FIG. 2A after a partial rotation of indexing members 22. The rotation of indexing members 22 may orient indexing protrusions 24 such that one utensil 20 is separated from a stack of utensils and dispensed into receptacle 14. According to some embodiments, each indexing member 22 comprises more than one indexing protrusion 24 in order to separate one utensil 20 while simultaneously retaining the remaining utensils 20 in a stack in chute 13. For example, FIG. 2B shows a second set of indexing protrusions 24 contacting and retaining a stack of utensils in chute 13 while one utensil 20 has been released for dispensing.

After dispensing utensil 20, indexing members 22 may be configured to either return to a pre-dispensing orientation or assume a post-dispensing orientation. For example, in some embodiments indexing members 22 may rotate in one direction from an initial orientation to separate and dispense utensil 20 from the stack of utensils, and thereafter rotate in the opposite direction to return to the initial, pre-dispensing orientation. On the other hand, according to some embodiments, indexing members 22 may rotate in one direction to separate and dispense utensil 20 from the stack of utensils, and either remain in that orientation or rotate further in the same direction in order to reach a post-dispensing orientation distinct from the pre-dispensing orientation.

Figure 3:
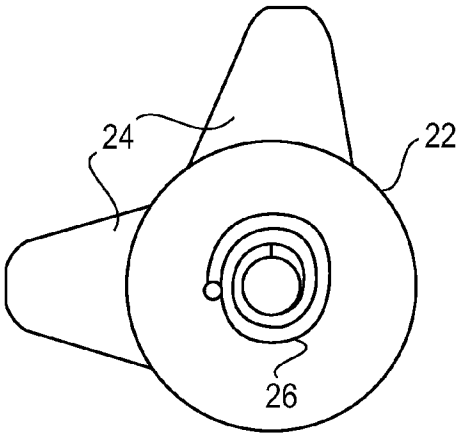
FIG. 3 is a schematic view of an indexing member.

As shown in FIG. 3, some embodiments of indexing members 22 may return to a pre-dispensing orientation via counter-rotation influenced by indexing springs 26. In some embodiments, for example, indexing spring 26 may comprise a spring attached at one end to indexing member 22 and attached at the other end to a static point associated with dispenser 10. It is contemplated that indexing spring 26 may be any type of spring suitable for returning indexing member 22 to its pre-dispensing orientation, for example, a coil spring, cantilever spring, torsion spring, tension spring, or the like.

In the embodiment shown in FIG. 3, an indexing spring 26 is located on the face of indexing member 22. In some embodiments, as indexing member 22 rotates from a pre-dispensing position, indexing spring 26 may apply a counter-rotational force. In particular, indexing spring 26 may apply a force sufficient to return indexing member 22 to its pre-dispensing position after a user terminates operation of actuator 16.

Figure 4A:
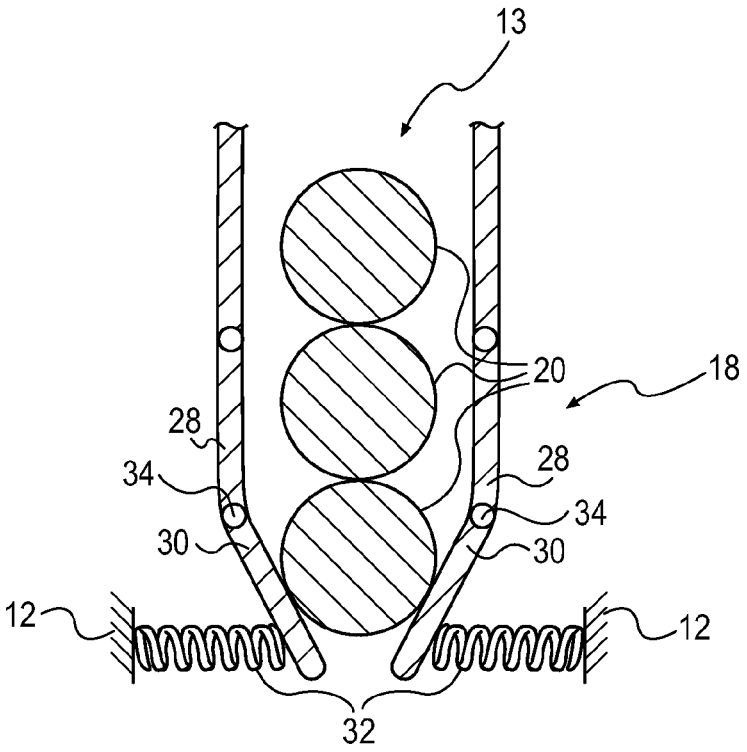
FIG. 4A is a schematic partial cross-sectional view along line A-A of FIG. 1 showing another dispensing mechanism in a first condition.

FIG. 4A shows a schematic partial cross-sectional view of another embodiment of dispensing mechanism 18 along line A-A of FIG. 1, in a first condition in which dispensing is not in progress. Dispensing mechanism 18 includes a plurality of rotatably-linked members 28 and 30 configured to separate a utensil 20 from a stack of utensils in chute 13. While FIG. 4A shows a plurality of linked members 28 and 30 on each side of utensil 20, any number of pluralities of linked members 28 and 30 may be utilized by dispensing mechanism 18 including a single plurality of linked members 28 and 30. As shown in FIG. 4A, rotatably-linked members 28 and 30 may include at least one pair of first rotatably-linked members 28 and at least one pair of second rotatably-linked members 30. According to some embodiments, first rotatably-linked members 28 and second rotatably-linked members 30 may be connected via at least one joint or pin 34. Joint 34 may be configured to allow for substantially free rotational movement in at least one direction. In some embodiments, rotatably-linked members 28 and 30 may be configured such that the stack of utensils is retained within dispensing mechanism 18, housing 12, and/or chute 13 until a user activates actuator 16 of dispenser 10.

While any number of configurations may be used to retain utensils 20 in chute 13, FIG. 4A shows a pair of resistance springs 32 in contact with second rotatably-linked members 30. According to some embodiments, resistance springs 32 contact second rotatably-linked members 30 closer to the end of members 30 opposite first rotatably-linked members 28. Resistance springs 32 may apply force to second rotatably-linked members 30 such that, while a user is not operating dispenser 10, the distance between second rotatably-linked members 30 is shortest between the ends of members 30 opposite first rotatably-linked members 28 (e.g., FIG. 4A). In such an embodiment, second rotatably-linked members 30 apply a retaining force to utensil 20 such that utensil 20 remains in the stack of utensils in chute 13.

Figure 4B:
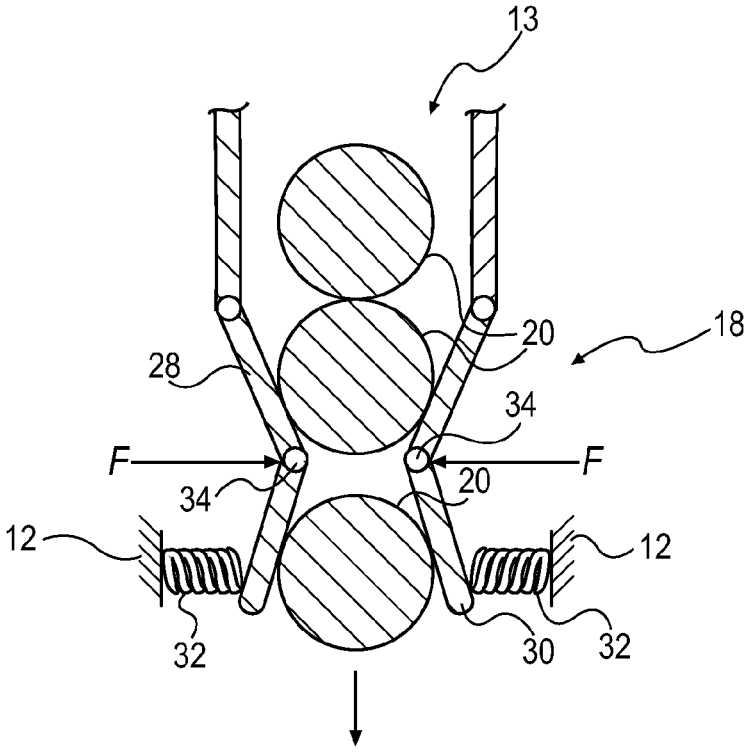
FIG. 4B is a schematic partial cross-sectional view along line A-A of FIG. 1 showing the dispensing mechanism of FIG. 4A in a second condition.

FIG. 4B shows dispensing mechanism 18 in a second condition in which utensil 20 is being dispensed. As shown in FIG. 4B, a pair of dispensing forces F may be applied to joints 34 such that a utensil 20 is separated from the stack of utensils and dispensed. For example, dispensing forces F may be applied by a user's activation of actuator 16, which transfers force, either directly or indirectly, to one or more joints 34. Alternatively, dispensing forces F may be generated in response to another mechanism. In some embodiments, dispensing forces F may be applied in one or more areas other than joints 34. Additionally, in some embodiments, only one dispensing force F is applied to rotatably-linked members 28 and 30.

In the embodiment shown in FIGS. 4A and 4B, dispensing forces F cause a pinching effect, decreasing the distance between joints 34 and counteracting resistance springs 32. The pinching effect may apply one of either a separating force and a retaining force to at least one utensil 20. In some embodiments, second rotatably-linked members 30 may apply a separating force to one utensil 20 while first rotatably-linked members 28 may apply a retaining force to the remaining, un-dispensed utensils 20 of the stack of utensils. According to some embodiments, utensil 20 may be shaped such that, as joints 34 move closer to one another, second rotatably-linked members 30 rotate about utensil 20, which may cause the distance between the ends of the members that are not attached to first rotatably-linked members 28 to increase. Depending on the magnitude of dispensing force F, second rotatably-linked members 30 may move enough to release utensil 20. Dispensing forces F may be more important in the separation of utensils 20 that are coupled together by adhesive or any other securing mechanism.

According to the embodiment shown in FIGS. 4A and 4B, after utensil 20 is dispensed, the user may release or deactivate actuator 16 and thereby reduce or eliminate dispensing force F. In such an example, resistance springs 32 may apply a force to second rotatably-linked members 30 sufficient to return second rotatably-linked members 30 and/or first rotatably-linked members 28 to pre-dispensing positions without dispensing more than one utensil 20.

It will be apparent to those skilled in the art that various modifications and variations can be made to the structures and methodologies described herein. Thus, it should be understood that the invention is not limited to the subject matter discussed in the description. Rather, the present disclosure is intended to cover modifications and variations.

What is claimed is:

1. A dispenser for dispensing cutlery, the dispenser comprising:

a housing configured to contain a plurality of utensils for dispensing;

a dispensing mechanism comprising at least one pair of first and second indexing members configured to separate a utensil from a stack of utensils, wherein the first indexing member rotates in a generally clockwise direction and the second indexing member rotates in a generally counter-clockwise direction when separating the utensil from the stack, and the first indexing member rotates in a generally counter-clockwise direction and the second indexing member rotates in a generally clockwise direction after the utensil is separated from the stack, and wherein the stack is at least partially disposed between the pair of indexing members; and a receptacle configured to receive the utensil separated from the stack of utensils.

2. The dispenser of claim 1, wherein the indexing members rotate in a first rotational direction from an initial orientation an amount sufficient to separate a utensil from the stack of utensils, and thereafter rotate in a second rotational direction that is opposite of the first direction to return to the initial orientation.

3. The dispenser of claim 1, wherein the dispensing mechanism comprises at least one spring configured to influence the orientation of the indexing members by providing a counter-rotational force to return the dispensing mechanism to a pre-dispensing position.

4. The dispenser of claim 1, wherein the first and second indexing members are configured to rotate in opposite directions by increments sufficient to separate a utensil from the stack of utensils.

5. A dispenser for dispensing cutlery, the dispenser comprising:

a housing configured to contain a stack of utensils for dispensing, wherein the stack of utensils comprises a lowermost utensil to be dispensed from the stack and a next-in-line utensil disposed above the lowermost utensil;

a dispensing mechanism comprising a first row and a second row of linked members disposed about the stack, both the first and second rows of linked members adapted to engage the stack of utensils, the dispensing mechanism configured to separate a utensil from a stack of utensils;

wherein the linked members comprise at least two members coupled via a joint, and wherein at least one linked member from the first row rotates in a generally clockwise direction to hold back the next-in-line utensil from being dispensed and at least one linked member from the second row rotates in a generally counter-clockwise direction to hold back the next-in-line utensil from being dispensed when separating the lowermost utensil from the stack, and wherein the at least one linked member from the first row rotates in a generally counter-clockwise direction and the at least one linked member from the second row rotates in a generally clockwise direction after the lowermost utensil is separated from the stack, and a receptacle configured to receive the utensil separated from the stack of utensils.

6. The dispenser of claim 5, wherein at least one of the linked members in the first row and the second row is configured to provide one of a separating force and a retaining force to at least one utensil.

7. The dispenser of claim 5, wherein the stack of utensils further comprises a plurality of utensils disposed above the next-in-line utensil.

8. The dispenser of claim 5, wherein the dispensing mechanism comprises at least one spring configured to influence an orientation of the linked members.

9. The dispenser of claim 5, wherein the dispensing mechanism comprises at least one self-biasing joint configured to influence an orientation of the linked members.

10. The dispenser of claim 5, wherein the stack of utensils is at least partially disposed between the first row of linked members and the second row of linked members.

11. A method for dispensing cutlery from a dispenser, the method comprising:

providing a dispenser for dispensing cutlery;

providing a plurality of utensils for dispensing, the utensils adapted to be positioned within the dispenser;

indexing first and second indexing members such that a utensil can be separated from a stack of utensils, wherein the first indexing member rotates in a generally clockwise direction and the second indexing member rotates in a generally counter-clockwise direction when separating the utensil from the stack, and the first indexing member rotates in a generally counter-clockwise direction and the second indexing member rotates in a generally clockwise direction after the utensil is separated from the stack, and wherein the stack is at least partially disposed between the first and second indexing members; and providing access to the utensil separated from the stack of utensils.

12. The method of claim 11, wherein providing a plurality of utensils comprises providing a plurality of separably coupled utensils.

13. The method of claim 11, wherein indexing first and second indexing members comprises:

rotating the first and second indexing members in opposite directions from an initial orientation such that a utensil is separated from the stack of utensils; and returning the first and second indexing members to the initial orientation.

14. The method of claim 13, wherein returning the first and second indexing members to the initial orientation is facilitated by at least one spring.

15. The method of claim 11, wherein indexing the first and second indexing members is facilitated by activating an actuator operably coupled to the first and second indexing members.

16. The method of claim 11, wherein providing access to the utensil comprises providing a receptacle positioned to receive the utensil separated from the stack of utensils.

17. A method for dispensing cutlery from a dispenser, the method comprising:

providing a dispenser for dispensing cutlery, the dispenser including a dispensing mechanism comprising a first row and a second row of linked members disposed about a stack of utensils, both the first and the second rows of linked members adapted to engage the stack of utensils, wherein the stack of utensils comprises a lowermost utensil to be dispensed from the stack and a next-in-line utensil disposed above the lowermost utensil; and wherein the linked members comprise at least two members coupled via a joint;

manipulating at least one linked member from the first row in a generally clockwise direction to hold back the next-in-line utensil from being dispensed and at least one linked member from the second row in a generally counter-clockwise direction to hold back the next-in-line utensil from being dispensed when separating the lowermost utensil from the stack, and wherein the at least one linked member from the first row rotates in a generally counter-clockwise direction and the at least one linked member from the second row rotates in a generally clockwise direction after the lowermost utensil is separated from the stack, and providing access to the utensil separated from the stack of utensils.

18. The method of claim 17, wherein at least one of the rows of linked members comprise a plurality of rotatably-linked members.

19. The method of claim 17, wherein manipulating the linked members further comprises providing a separating force to the lowermost utensil and a retaining force to the next-in-line utensil.

20. The method of claim 17, wherein manipulating the linked members comprises rotating at least one linked member of each row about the joint.

21. The method of claim 17, wherein manipulating the linked members is facilitated by activating an actuator operably coupled to the linked members.

22. A method for dispensing cutlery from a dispenser, the method comprising:

providing a dispenser for dispensing cutlery;

providing a plurality of utensils for dispensing within the dispenser;

indexing first and second indexing members such that a utensil can be separated from a stack of utensils, each indexing member comprising one or more protrusions that are adapted to engage a utensil to be dispensed from the stack, wherein the first indexing member rotates in a generally clockwise direction and the second indexing member rotates in a generally counter-clockwise direction when separating the utensil from the stack, and the first indexing member rotates in a generally counter-clockwise direction and the second indexing member rotates in a generally clockwise direction after the utensil is separated from the stack, and wherein the stack is at least partially disposed between two of the first and second indexing members; and dispensing the utensil separated from the stack of utensils.

23. The method of claim 22, wherein the plurality of utensils comprises a plurality of separably coupled utensils.

24. The method of claim 22, wherein the first and second indexing members are adapted to engage the lowermost utensil of the stack of utensils.

25. The method of claim 22, wherein each of the first and second indexing members comprises two protrusions, and wherein the separated utensil is disposed between the two protrusions from each indexing member.

26. A dispenser for dispensing cutlery, the dispenser comprising:

a housing configured to contain a plurality of utensils for dispensing;

a dispensing mechanism comprising at least one pair of first and second indexing members configured to separate a utensil from a stack of utensils, each indexing member comprising one or more protrusions that are adapted to engage a utensil to be dispensed from the stack, wherein the first indexing member rotates in a generally clockwise direction and the second indexing member rotates in a generally counter-clockwise direction when separating the utensil from the stack, and the first indexing member rotates in a generally counter-clockwise direction and the second indexing member rotates in a generally clockwise direction after the utensil is separated from the stack, and wherein the stack is at least partially disposed between the pair of indexing members; and a receptacle configured to receive the utensil separated from the stack of utensils.

27. The dispenser of claim 26, wherein the indexing members rotate in a first rotational direction from an initial orientation an amount sufficient to separate a utensil from the stack of utensils, and thereafter rotate in a second rotational direction that is opposite of the first direction to return to the initial orientation.

28. The dispenser of claim 26, wherein the first and second indexing members are configured to rotate in opposite directions by increments sufficient to separate a utensil from the stack of utensils.

29. The dispenser of claim 26, wherein each of the first and second indexing members comprises two protrusions, and wherein the separated utensil is disposed between the two protrusions from each indexing member.

30. The dispenser of claim 26, wherein the first and second indexing members are adapted to engage the lowermost utensil of the stack of utensils.

31. A method for dispensing cutlery from a dispenser, the method comprising:

providing a dispenser for dispensing cutlery;

providing a plurality of utensils for dispensing, the utensils adapted to be positioned within the dispenser;

indexing first and second indexing members such that a utensil can be separated from a stack of utensils, wherein the first indexing member rotates in a generally clockwise direction and the second indexing member rotates in a generally counter-clockwise direction when separating the utensil from the stack, and the first indexing member rotates in a generally counter-clockwise direction and the second indexing member rotates in a generally clockwise direction after the utensil is separated from the stack, and wherein the stack is at least partially disposed between the first and second indexing members; and providing access to the utensil separated from the stack of utensils.

32. The method of claim 31, wherein indexing first and second indexing members comprises:

rotating the first and second indexing members in opposite directions from an initial orientation such that a utensil is separated from the stack of utensils; and returning the first and second indexing members to the initial orientation.

33. The method of claim 31, wherein indexing the first and second indexing members is facilitated by activating an actuator operably coupled to the first and second indexing members.

34. The method of claim 31, wherein the first and second indexing members are adapted to engage the lowermost utensil of the stack of utensils.

35. The method of claim 31, wherein each of the first and second indexing members comprises two protrusions, and wherein the separated utensil is disposed between the two protrusions from each indexing member.

36. The method of claim 31, wherein providing access to the utensil comprises providing a receptacle positioned to receive the utensil separated from the stack of utensils.

* * * * *